US006920726B2

(12) United States Patent
Bielefeld et al.

(10) Patent No.: US 6,920,726 B2
(45) Date of Patent: Jul. 26, 2005

(54) HOLLOW PLASTIC SECTION

(75) Inventors: Hans-Walter Bielefeld, Bielefeld (DE); Matthias Senneca, Bielefeld (DE); Ralf Kämper, Münster (DE)

(73) Assignee: Schüco International KG, Bielefeld (DE)

( * ) Notice: Subject to any disclaimer, the term of this patent is extended or adjusted under 35 U.S.C. 154(b) by 0 days.

(21) Appl. No.: 10/041,789

(22) Filed: Jan. 8, 2002

(65) Prior Publication Data

US 2002/0059759 A1 May 23, 2002

Related U.S. Application Data

(63) Continuation of application No. PCT/EP00/06636, filed on Jul. 12, 2000.

(30) Foreign Application Priority Data

Jul. 15, 1999 (DE) ..... 199 33 099
Jul. 15, 1999 (DE) ..... 299 12 375 U

(51) Int. Cl.[7] ..... E06B 3/30

(52) U.S. Cl. ..... 52/204.53; 52/309.15; 52/309.16; 52/656.1; 52/656.2; 52/730.3; 52/730.4; 52/734.1; 52/734.2; 49/504; 49/DIG. 2

(58) Field of Search ..... 52/309.16, 309.15, 52/656.1, 656.2, 204.53, 730.3, 730.4, 734.2, 730.1, 731.1, 731.2, 732.2; 49/DIG. 2

(56) References Cited

U.S. PATENT DOCUMENTS 3,470,598 A * 10/1969 Berthelsen ..... 52/309.16
4,130,976 A * 12/1978 Kesseler et al. ..... 52/656
4,341,831 A * 7/1982 Kleiss ..... 428/188
4,492,063 A * 1/1985 Schock et al. ..... 52/309.7
4,740,405 A * 4/1988 Tanaka et al. ..... 428/45
5,175,401 A * 12/1992 Arcas ..... 181/292
5,634,306 A * 6/1997 Riegelman ..... 52/309.16
6,003,277 A * 12/1999 Graham et al. ..... 52/309.7

FOREIGN PATENT DOCUMENTS

| | | |
|---|---|---|
| DE | 18 06 726 U | 2/1960 |
| DE | 20 10 441 A | 10/1971 |
| DE | 12 81 664 B | 10/1973 |
| DE | 76 17 407 U1 | 12/1979 |
| DE | 28 33 738 A1 | 2/1980 |
| DE | GM 81 11 425.7 | 6/1982 |
| DE | 43 38 181 C2 | 12/1994 |
| DE | 43 31 816 C2 | 3/1995 |
| DE | 44 26 331 A | 2/1996 |
| DE | 296 10 652 U1 | 8/1997 |
| DE | 196 26 182 A1 | 1/1998 |
| EP | 0 153 758 A | 9/1985 |
| EP | 0 828 052 A | 3/1998 |
| FR | 2 118 822 A | 7/1972 |

* cited by examiner

*Primary Examiner*—Carl D. Friedman
*Assistant Examiner*—Yvonne M. Horton
(74) *Attorney, Agent, or Firm*—Henry M. Feiereisen

(57) ABSTRACT

A hollow plastic section, includes a frame section defining a longitudinal axis and having an interior subdivided in several inner chambers by a plurality of partition walls extending in a direction of the longitudinal axis, Received in the interior is a plurality of stiffening elements arranged separate from one another, without interconnection, for realizing a reinforcement of the frame section. The stiffening elements may be made of metal or may be configured as bands or strips of fiber-reinforced plastic.

15 Claims, 3 Drawing Sheets

32
24
33
27
25
6
26
25
30
6
28
35
34
25
25
31
29
23
A
A

HOLLOW PLASTIC SECTION

CROSS-REFERENCES TO RELATED APPLICATIONS

This application is a continuation of prior filed copending PCT International application no. PCT/EP00/06636, filed Jul. 12, 2000.

This application claims the priority of German Patent Applications, Serial No. 199 33 099.9, filed Jul. 15, 1999, and 299 12 375.8, filed Jul. 15, 1999, the subject matter of which is incorporated herein by reference.

BACKGROUND OF THE INVENTION

The present invention relates to a hollow plastic section with embedded metallic reinforcement, and more particularly to a frame section for windows or doors.

German utility model DE-GM 81 11 425 describes a plastic frame section in which the fiber-reinforced plastic bands are either embedded in the outer walls or secured to the inner side of the outer wall by a foamed core or by glue. Attachment of these fiber-reinforced plastic bands is realized solely by the adhesion between the individual materials. This adhesion is effected by an adhesive action of the frame materials with the reinforcement bands and between the reinforcement band and the foamed core. This adhesion through gluing or forced connection is insufficient in conjunction with the force transfer through dynamic loads upon the hollow plastic section in order to ensure the shearing strength between the reinforcement band and the frame section.

Furthermore, the known frame profile has an interior chamber of large cross section so that a heat convection flow may form in this large-volume inner space and impair the heat insulation.

German Pat. No. DE 28 33 738 A1 discloses a further plastic frame section having plastic walls bounding a large-volume inner chamber which accommodates tubular reinforcement sections extending across the inner width of the inner chamber and resting against the inside surfaces of the chamber walls. These tubular metal sections form a good heat conductor between the outer surfaces of the frame section. Further impairing a heat insulation is the formation of a heat convection flow in the large-volume inner space and the presence of a heat radiation from the metallic surfaces.

It would therefore be desirable and advantageous to provide an improved hollow plastic section which obviates prior art shortcomings and which is so configured that a high heat insulation as well as a great static stress-absorbing capability are realized in a simple manner.

SUMMARY OF THE INVENTION

According to one aspect of the present invention, a hollow plastic section includes a frame section defining a longitudinal axis and having an interior subdivided in several chambers by a plurality of partition walls extending in a direction of the longitudinal axis; and a plurality of stiffening elements received in the interior separate from one another, without interconnection, for realizing a reinforcement of the frame section.

The present invention resolves prior art problems by providing a plurality of inner chambers, which have each a small volume, so as to prevent a convection flow which would adversely affect the heat insulation. As the strip-shaped stiffening elements, preferably made of metal, are not interconnected, a heat conduction is eliminated between these stiffening elements.

According to another feature of the invention, the hollow plastic section includes several inner chambers which are bounded by partition walls, extending in longitudinal direction of the section, and have a small cross section, with the reinforcement elements being provided in the length region or in the area between the longitudinal edges with means such a roughenings, knurlings, punchings or the like, by which a positive fit is realized. These positive fit providing means realize a high shearing resistance between the fiber-reinforced stiffening elements of plastic and the frame section.

The plurality of inner chambers, which have a small cross section and small volume only, prevents the formation of a convection flow which would impair the heat insulation.

The stiffening elements, which preferably have a rectangular cross section, may have a surface with high reflective radiation so that the heat insulation of the hollow plastic section is not impaired through heat radiation.

According to another feature of the present invention, the stiffening elements may be made of fiber-reinforced plastic. All currently known fibers are suitable for fabrication of the plastic stiffening elements, such as glass fibers, carbon fibers, natural fibers—like hemp and sisal—and the like. The stiffening elements and the reinforcement elements may be made, for example, of PVC, polyamide, polyester or epoxy resin.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
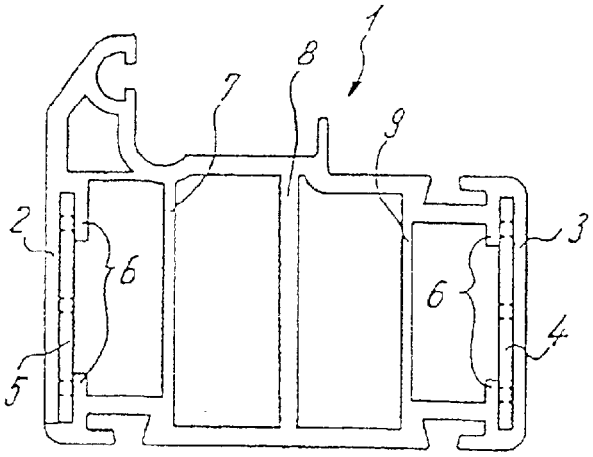
FIG. 1 is a sectional view of a frame section for windows and doors, which has band-shaped or strip-shaped stiffening elements arranged on the inside of the exterior walls.

Throughout all the Figures, same or corresponding elements are generally indicated by same reference numerals.

Turning now to the drawing, and in particular to FIG. 1, there is shown a sectional view of a frame section, generally designated by reference numeral 1 and useable for windows and doors. The frame section 1 is made of plastic and has band-shaped or strip-shaped stiffening elements 4, 5 made of metal or fiber-reinforced plastic and disposed on the inner sides of exterior walls 2, 3. The exterior walls 2, 3 form the visible surfaces of the frame section 1 and have a dimension which is only slightly impacted by the arrangement of the strip-shaped stiffening elements 4, 5. The stiffening elements 4, 5 are located in semi-open or closed chambers and are secured there resistant to shearing through adhesion or through positive fit.

Normally, the stiffening elements are co-extruded during fabrication of the frame section 1.

In the exemplified embodiment of the plastic frame section 1, the stiffening elements 4, 5 have longitudinal edges which are embraced by restraining ribs 6. The stiffening elements 4, 5 may be provided in the area of their length zone with means that form a positive fit, such as roughenings, knurlings, punchings or the like, so as to realize an intimate connection between frame section 1 and the stiffening elements 4, 5.

The frame section 1 has a hollow space which is bounded by the exterior walls 2, 3 and divided in hollow chambers by thin partition walls 7, 8, 9. Any number of hollow chambers may be provided which may even have same width. Through provision of a plurality of such hollow chambers, the formation of heat convection flows is precluded.

Figure 2:
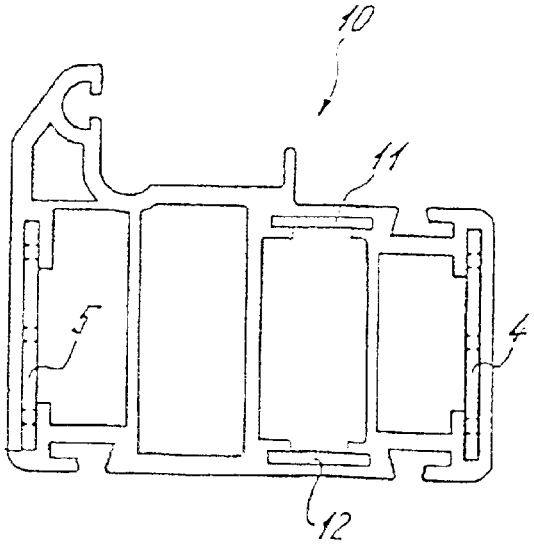
FIG. 2 is a sectional view of a frame section with vertical and horizontal strip-shaped stiffening elements.

FIG. 2 shows a plastic frame section 10 which is modified with respect to the frame section 1 according to FIG. 1 in such a manner that in addition to vertical stiffening elements 4, 5 also horizontally extending band-shaped or strip-shaped stiffening elements 11, 12 are provided on the inner side of the fold walls of the frame section 10. The stiffening elements 11, 12, which may be formed with means that provide a positive fit in the area of the longitudinal edge, such as roughenings, knurlings, punchings and the like, not only contribute to the increase of the section static, but also contribute to a secure attachment of fittings and attachment of the finished components themselves by means of screws and/or other typical fastening means.

These stiffening elements 11, 12 are only partially arranged in relation to the section length for heat technical reasons, that is at areas where they are necessary for fixation of the fastening means.

Figure 3:
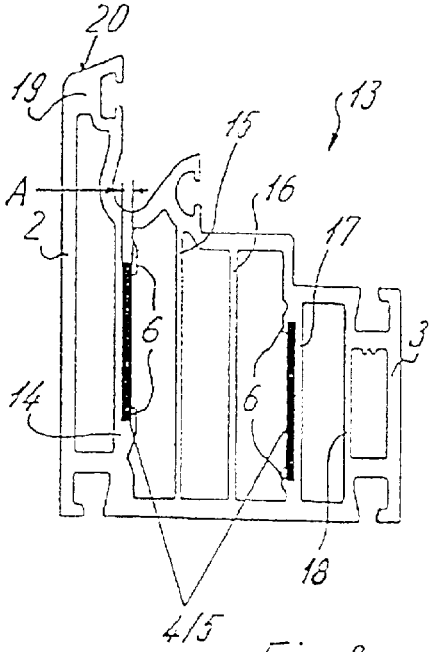
FIG. 3 is a sectional view of a frame section in which band-shaped or strip-shaped stiffening elements are provided at a distance to the exterior walls.

FIG. 3 shows a frame section 13 in which the strip-shaped stiffening elements 4, 5 are arranged in partition walls 14, 17 extending in parallel relationship to the exterior walls 2, 3. These partition walls 14, 17 are provided in the proximity of the exterior walls 2, 3. The stiffening elements 4, 5 may also be anchored in the partition walls 14, 17 by means that provide a positive fit.

The frame section 13 includes further partition walls 15, 16 which bound the inner chambers with slight volume and extend in parallel relationship to the exterior walls 2 and 3.

Of course, it is also conceivable to secure stiffening elements 4, 5 in or at these partition walls 15, 16 and, optionally, to anchor them through means that provide a positive fit.

The stiffening elements 4, 5 are retained at their longitudinal edges in longitudinal direction of the frame section 13 by restraining ribs 6 upon the partition wall 14 and 17, respectively.

A characteristic feature of the frame section 13 is the disposition of the stiffening elements 4, 5 in one plane which does not extend through a visible edge of the section of the later window or door.

The exterior wall 2 terminates in the area of the sash fold or glass fold in a sash stop 19 which forms in upwards direction a visible area of the window or door. Through prolongation of the alignment plane of the stiffening elements 4, 5 and designation of this alignment plane with A, it can be seen that both alignment planes of the stiffening elements 4, 5 do not traverse the visible area 20.

Figure 4:
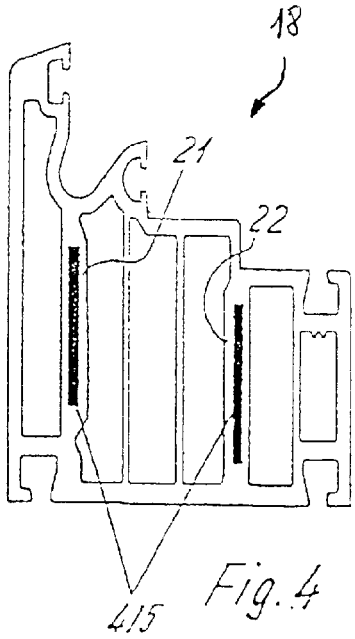
FIG. 4 is a sectional view of a frame section in which strip-shaped stiffening elements are arranged in pockets of partition walls.

FIG. 4 shows a frame section 18 which substantially corresponds to the frame section 13 of FIG. 3. The only difference in this construction is the arrangement of continuous walls 21, 22, instead of the restraining ribs 6 for receiving the ends of the stiffening elements 4, 5, for formation of a closed receiving pocket or closed receiving space for the stiffening elements 4, 5.

This complete embedment of the stiffening elements 4, 5 affords the possibility to reduce the weight of the stiffening elements 4, 5 through respective recesses while maintaining the necessary static so that the amount of utilized metal mass is reduced. This is advantageous in a heat technical sense, on the one hand, and allows implementation of a positive fit between the stiffening elements 4, 5 and the hollow plastic section, on the other hand. When the stiffening elements 4, 5 are made of fiber-reinforced plastic, there is also the possibility to provide exclusively in the area of the longitudinal edge of the stiffening elements 4, 5 positive fit enhancing means which can be anchored in the material of the walls 21, 22 and thereby increase the shear resistance between the stiffening elements and the plastic section.

Figure 5:
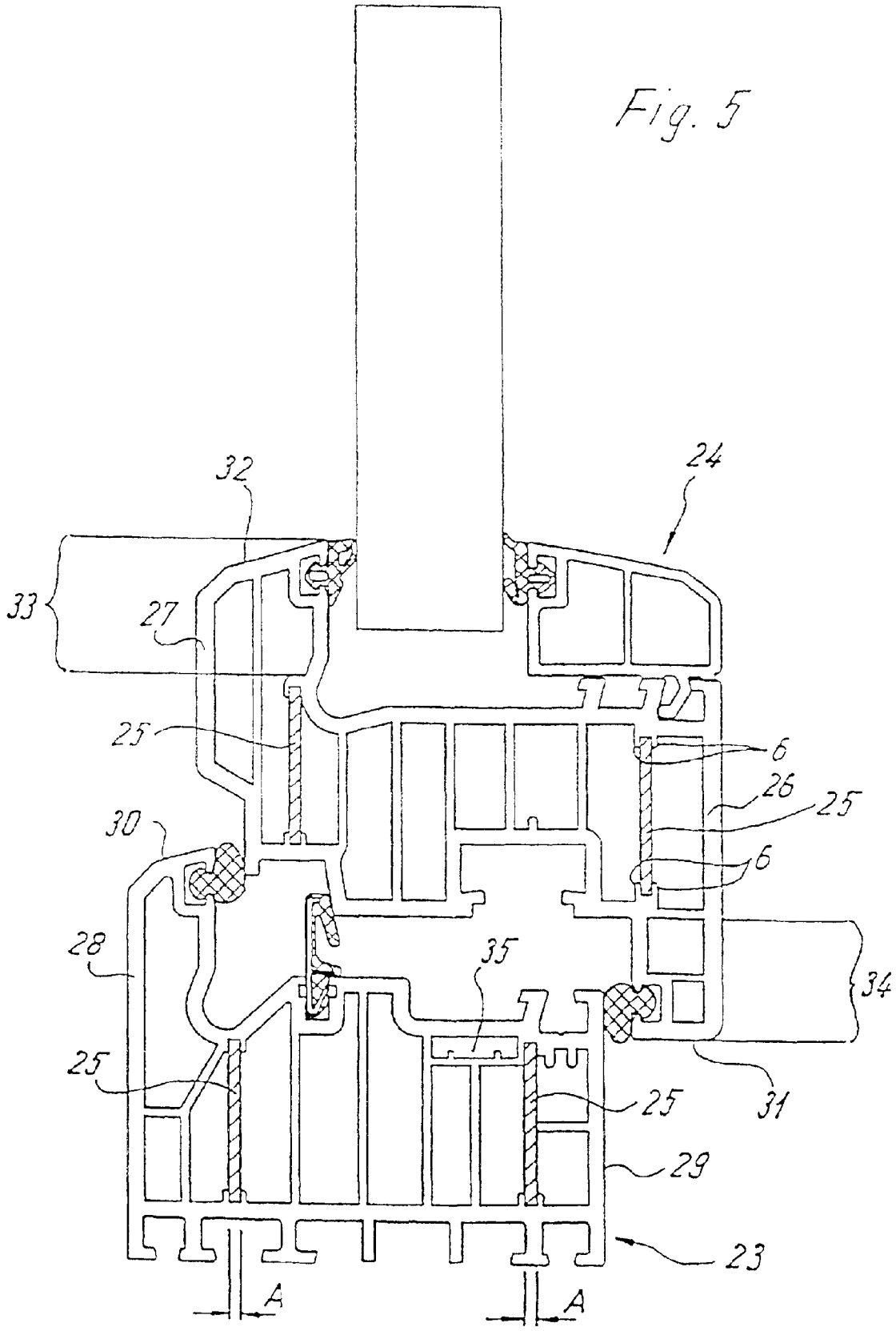
FIG. 5 is a sectional view of a sash and a casement for a window or a door.

FIG. 5 shows a sectional view through a frame section combination of a window or a door comprised of a casement 23 and a sash 24. The casement 23 and the sash 24 have stiffening elements 25 near the exterior walls 26, 27, 28, 29, and form partition walls between two inner chambers. The longitudinal edges of the stiffening elements 25, which may be provided with positive fit enhancing means, are received and held on both sides through restraining ribs 6 and by the inner wall material of the frame section.

In the area of the casement 23, the outer planes A of the stiffening elements 25 are positioned far enough within the section contour that these planes do not traverse a visible surface 30.

In contrast thereto, the lateral boundary planes of the stiffening elements 25 intersect a visible surface 31 and 32, respectively, in the area of the sash 24. Still, it is ensured here that the longitudinal edge of the stiffening elements 25, which points to the visible surface, has a sufficient distance to this visible surface. The stiffening elements 25 extend solely across the core area of the sash section 24 so that stop zones 33 and 34 are kept free from the stiffening element 25.

Provided in the casement section 23 in the direction to the upper fold is a chamber 35 for receiving a stiffening element 11. The stiffening element 11 may be arranged during extrusion or also subsequently in the frame section 23.

Figure 6:
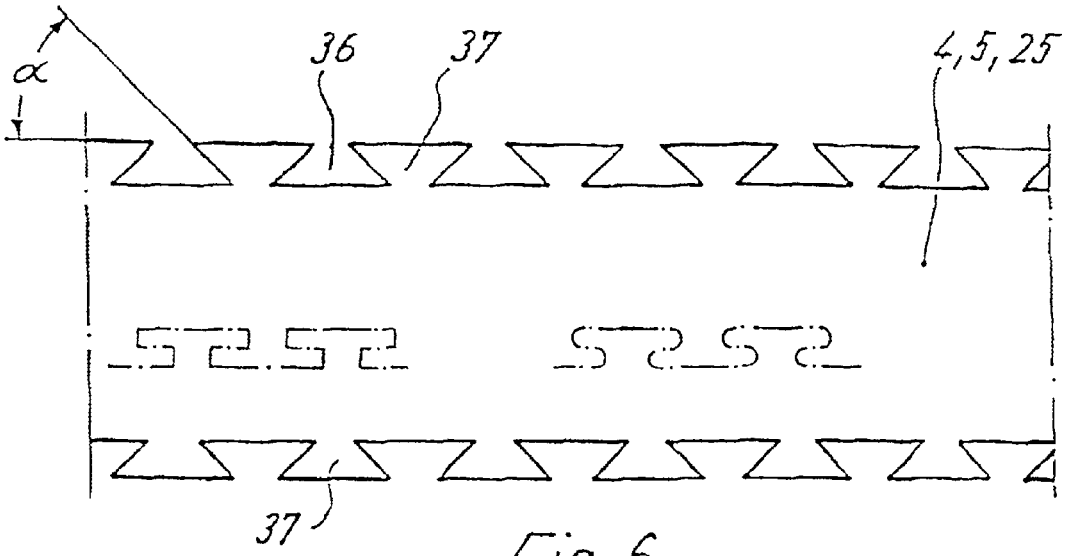
FIG. 6 is a schematic illustration of one embodiment of a strip-shaped stiffening element.

FIG. 6 shows a band-shaped or strip-shaped stiffening element 4, 5, 25 which is provided on opposite longitudinal edges with punchings 36 for positive securement in the frame section. These punchings 36 thus establish an alternating arrangement of cutouts and projections along the longitudinal edges and are so configured as to realize a positive fit between the frame section and the stiffening element in longitudinal direction as well as in transverse direction to the stiffening element. The punching 36 covers a same surface area as the remaining element portion 37.

The rows of punchings are so arranged that the punching 36 on the one side is precisely confronted by an element portion 37.

This realizes that the extruded plastic mass is precisely identical at any time during extrusion of the stiffening element. It is ensured that always the same amount of plastic is required for the extrusion per section length. Varying material quantities per section length would lead during extrusion to a pulsating with different pressures, resulting in an impairment of the extrusion and of the section quality.

As an indentation is confronted by a same element portion, the same cross sectional area is present at each section through the stiffening element. The mass being displaced remains therefore always precisely the same.

Another condition is, however, that the punching 36 and the element portions 37 are precisely identical. In the illustration, the angle $\alpha$ of the punching is equal to 45°.

Of course, other punching configurations are conceivable, such as, e.g., stepped rectangular recesses which also result in an equivalence of the area, as indicated in FIG. 6. Other configurations are conceivable and applicable which include punchings, i.a. circles and semi-circles and which approximate with deviations the equivalence of the area.

Figure 7:
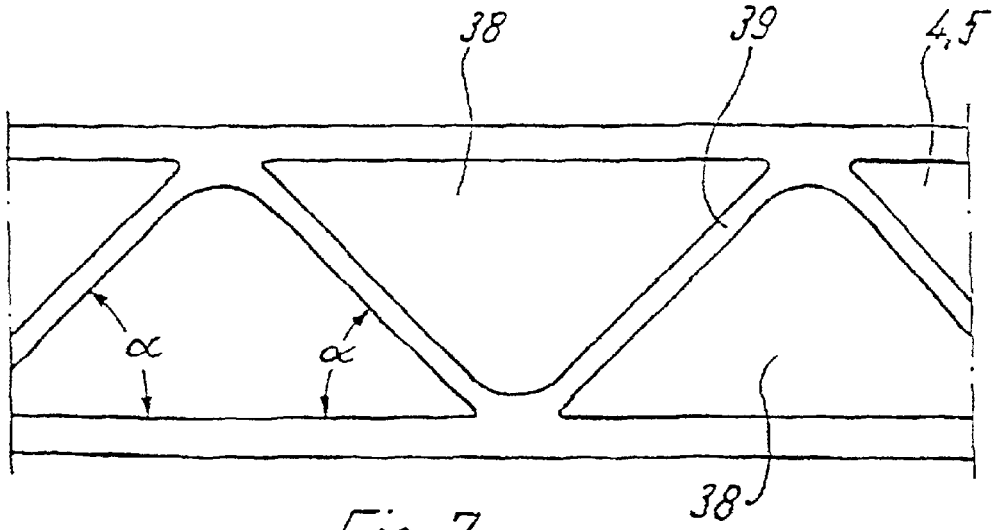
FIG. 7 is a schematic illustration of another embodiment of a strip-shaped stiffening element.

FIG. 7 shows a stiffening element 4, 5 which can be used, e.g., in frame section 18, shown in FIG. 4. The stiffening element 4, 5 is completely surrounded in this frame section by extruded plastic material. In order to save material for reducing the weight but also to improve the heat insulation, this stiffening element is provided with punchings 38, resulting in diagonal bars 39 therebetween. The punchings alternate in sequence whereby it is advantageous to form the angle $\alpha$ at the same time.

Punchings are, however, also possible which have triangles of different angles.

Here, it is also crucial that the cross-sectional area of the stiffening elements is always the same no matter how the cross section is laid so as to enable also in this case to work with precisely the same amount of extrusion material. The extrusion material is received by the punchings. The stiffening elements 4, 5, 25 are made of metal, preferably aluminum. The heat insulation of the plastic section is improved, i.e., deterioration of the heat flux, by so treating the surfaces of the stiffening elements as to attain a high radiation reflection. This can be implemented through reflective coatings.

This may also be attained through highly polished surfaces, anodizing or reflective coatings.

In FIGS. 1 and 2, the stiffening elements 4, 5 are arranged on the inner side of the exterior walls 2, 3, while in FIGS. 3 to 5, the stiffening elements 4, 5, 25 are provided in the neighborhood of the exterior walls. As can be seen from FIG. 5, the stiffening elements may also be used as partition walls between two inner chambers.

It is important that the stiffening elements are sufficiently spaced from the external visible surfaces because the stiffening elements can be slightly shortened relative to the cutting area of the frame sections for the welding operation during frame fabrication. This can be attained through milling by means of disk milling cutters or face cutters or through punching.

The end zone of the stiffening elements has to be treated in such a way that the visible surfaces of the frame sections are not damaged and a sufficiently good welding operation is ensured in optical as well as functional respects.

Under this aspect, the arrangement of the stiffening elements 25 in FIG. 5 has been implemented in relation to the stop webs 30, 31 and 32. When, e.g., providing in these frame sections the indentation in the end zone of the stiffening elements with disk milling cutters, a sufficient runout of the milling tool is ensured, without damaging the visible surfaces of the frame section.

FIG. 2 shows the possibility to arrange vertical stiffening elements 4, 5 as well as horizontal stiffening elements 11, 12 in a frame section. These stiffening elements are provided separate from one another so that these elements do not raise the heat conduction.

In general, the horizontal stiffening elements 11, 12 do not extend across the entire section length but cover only a portion of the section.

The stiffening elements 4, 5, 25 may be provided in the length region or in the area between the longitudinal edges with means that provide a positive fit, like roughenings, punchings or the like.

While the invention has been illustrated and described as embodied in a hollow plastic section, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. A hollow section, comprising:

a frame section made of plastic and defining a longitudinal axis, said frame section having an interior subdivided in several inner chambers by a plurality of partition walls extending in a direction of the longitudinal axis; and a plurality of stiffening elements made of metal and received in the interior separate from one another and without interconnection of the stiffening elements to one another, for forming some of the partition walls and for realizing a reinforcement of the frame section, wherein each of the stiffening elements has a rectangular cross section and is secured directly to the frame section, wherein each of the stiffening elements includes punchings which are so configured that application of any section in a direction transversely to the longitudinal axis of the frame section results in an area which covers a same amount of metal.

2. The hollow section of claim 1, wherein the stiffening elements have a strip-shaped structure.

3. The hollow section of claim 1, wherein the stiffening elements have a surface with high radiation reflection.

4. The hollow section of claim 1, wherein the stiffening elements have a surface provided with a reflective coating.

5. The hollow section of claim 1, wherein the stiffening elements are made of aluminum and are anodized.

6. The hollow section of claim 1, wherein the punchings are outwardly open, wherein the punchings at one longitudinal edge of the stiffening elements are in offset disposition to the punchings at the other longitudinal edge, wherein a portion formed between neighboring punchings covers a same area as the punching.

7. The hollow section of claim 1, wherein the frame section has exterior walls which form visible surfaces, and further comprising at least two stiffening elements which oppose one another and are secured to inner surfaces of the exterior walls.

8. The hollow section of claim 1, wherein the frame section has exterior walls which form visible surfaces, and further comprising at least two stiffening elements which oppose one another and are embedded in the exterior walls.

9. The hollow section of claim 2, wherein the strip-shaped stiffening elements have lateral boundary planes which do not intersect any visible surfaces of the frame section.

10. The hollow section of claim 9, wherein the strip-shaped stiffening elements have a sufficient distance to the visible surfaces of the frame section, so that an end zone of the stiffening elements is constructed for application by a tool, without damage to the visible surfaces of the frame section.

11. The hollow section of claim 1, wherein some of the stiffening elements extend vertically and some of the stiffening elements extend horizontally at a distance to the vertical stiffening elements.

12. The hollow section of claim 11, wherein the horizontal stiffening elements are provided only in an area of a portion of the frame section.

13. The hollow section of claim 1, wherein the frame section includes a receiving pocket receiving a loosely insertable attachment profile for a fitting.

14. The hollow section of claim 1, wherein the stiffening element has opposite longitudinal sides which are formed with said punchings to thereby alternate a projection and a cutout, wherein a projection of one of the longitudinal sides is opposed by a cutout in the other one of the longitudinal sides.

15. The hollow section of claim 1, wherein the stiffening element has opposite longitudinal sides, said punchings being formed in an area between the longitudinal sides.

* * * * *